US010302272B2

(12) United States Patent
Pahl et al.

(10) Patent No.: US 10,302,272 B2
(45) Date of Patent: May 28, 2019

(54) SCREEN PRINTED SHIELD

(71) Applicant: Eaton Intelligent Power Limited, Dublin (IE)

(72) Inventors: Christopher Joseph Pahl, Denver, CO (US); Adam Moore Foy, Parker, CO (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/113,896

(22) Filed: Aug. 27, 2018

(65) Prior Publication Data

US 2018/0363879 A1 Dec. 20, 2018

Related U.S. Application Data

(62) Division of application No. 14/965,541, filed on Dec. 10, 2015, now Pat. No. 10,077,880.

(51) Int. Cl.

| | |
|---|---|
| ***F21V 1/00*** | (2006.01) |
| ***F21V 1/26*** | (2006.01) |
| ***F21V 11/12*** | (2006.01) |
| ***F21V 11/14*** | (2006.01) |

(52) U.S. Cl.
CPC ..... *F21V 1/00* (2013.01); *F21V 1/26* (2013.01); *F21V 11/12* (2013.01); *F21V 11/14* (2013.01)

(58) Field of Classification Search
CPC ..... F21V 1/00; F21V 11/12; F21V 11/14
See application file for complete search history.

(56) References Cited

U.S. PATENT DOCUMENTS

2006/0023460 A1 2/2006 Steier

*Primary Examiner* — Thomas M Sember
(74) *Attorney, Agent, or Firm* — King & Spalding LLP

(57) ABSTRACT

A shield for a lighting fixture includes a panel that is optically transparent and a screen attached to the panel. The screen has opaque segments, where the opaque segments have gaps therebetween. The screen is screen printed onto the panel. The opaque segments are distributed on the panel in a pattern.

9 Claims, 10 Drawing Sheets

1200

SCREEN PRINTED SHIELD

CROSS REFERENCE TO RELATED APPLICATIONS

The present application claims priority to U.S. Nonprovisional patent application Ser. No. 14/965,541, filed Dec. 10, 2015 and titled "Screen Printed Shield," the entire content of which is incorporated herein by reference.

TECHNICAL FIELD

The present disclosure relates generally to lighting fixtures, and more particularly to a screen printed shield for lighting fixtures.

BACKGROUND

Some lighting fixtures such as suspended light fixtures may emit light upward and downward relative to the lighting fixture. Other types of light fixtures emit light either upward or downward relative to the lighting fixture. In some cases, it may be desirable to change the distribution of light by controlling the amount of light that exits the housing of the lighting fixture through an upper opening, a lower opening, or both.

To illustrate, the amount of light that exists through one or more openings of the housing of a lighting fixture may be set/adjusted to produce a desired overall distribution of light from the lighting fixture. For example, a metal cover may be used to cover a portion of the upper opening of a housing of a lighting fixture to control the amount of light that exists through an upper opening of the housing. However, in some cases, a metal cover may not allow a precise control over the amount and section of the opening of a lighting fixture that is covered by the metal cover.

Thus, in some applications, a shield that enables a more precise control over the sections of an opening of a light fixture that are covered to control the amount and distribution of light emitted by the light fixture may be desirable.

SUMMARY

This present disclosure relates to controlling the amount and distribution of light emitted from lighting fixtures. In some example embodiments, a shield for a lighting fixture includes a panel that is optically transparent and a screen attached to the panel. The screen has opaque segments, where the opaque segments have gaps therebetween. The screen is screen printed onto the panel. The opaque segments are distributed on the panel in a pattern.

In another example embodiment, a light fixture includes a housing, a light source disposed within the housing, and a shield attached to the housing. The shield is disposed above the light source. The shield includes a panel that is optically transparent and a screen attached to the panel. The screen has opaque segments, where the opaque segments have gaps therebetween. The screen is screen printed onto the panel. The opaque segments are distributed on the panel in a pattern.

In another example embodiment, a light fixture includes a housing, a light source disposed within the housing, and a shield attached to the housing. The shield is disposed below the light source. The shield includes a panel that is optically transparent and a screen attached to the panel. The screen has opaque segments, where the opaque segments have gaps therebetween. The screen is screen printed onto the panel. The opaque segments are distributed on the panel in a pattern.

These and other aspects, objects, features, and embodiments will be apparent from the following description and the claims.

BRIEF DESCRIPTION OF THE FIGURES

Reference will now be made to the accompanying drawings, which are not necessarily drawn to scale, and wherein.

Figure 1:
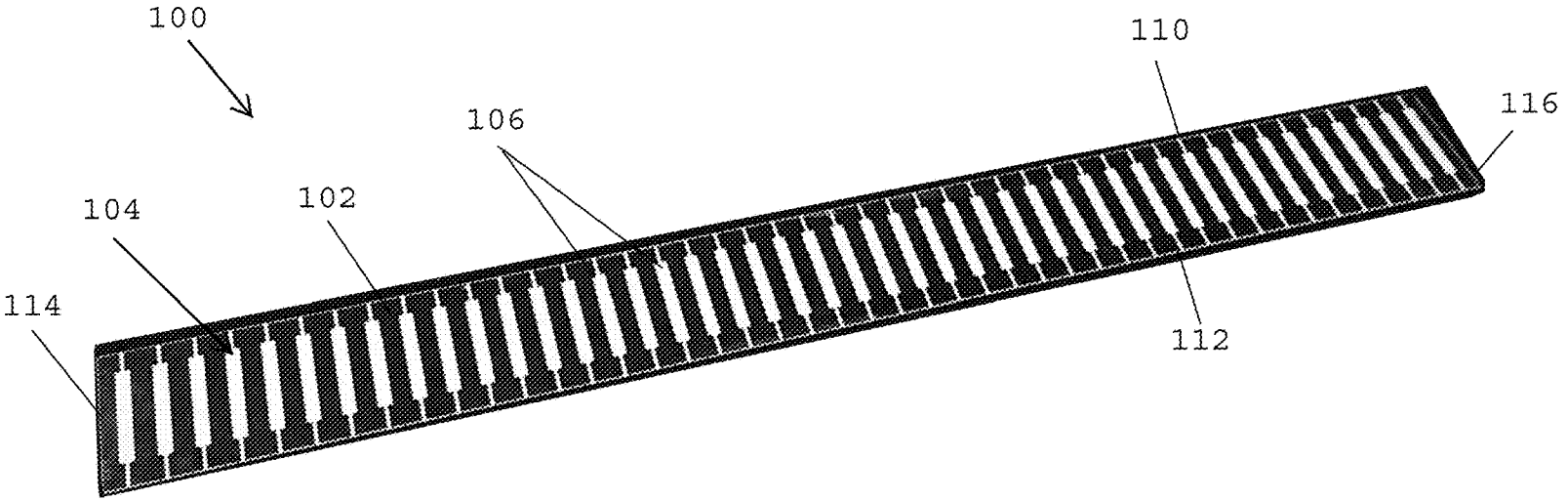
FIG. 1 illustrates an isometric view of a screen printed shield according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF EXAMPLE EMBODIMENTS

In the following paragraphs, particular embodiments will be described in further detail by way of example with reference to the figures. In the description, well known components, methods, and/or processing techniques are omitted or briefly described. Furthermore, reference to various feature(s) of the embodiments is not to suggest that all embodiments must include the referenced feature(s).

Figure 2:
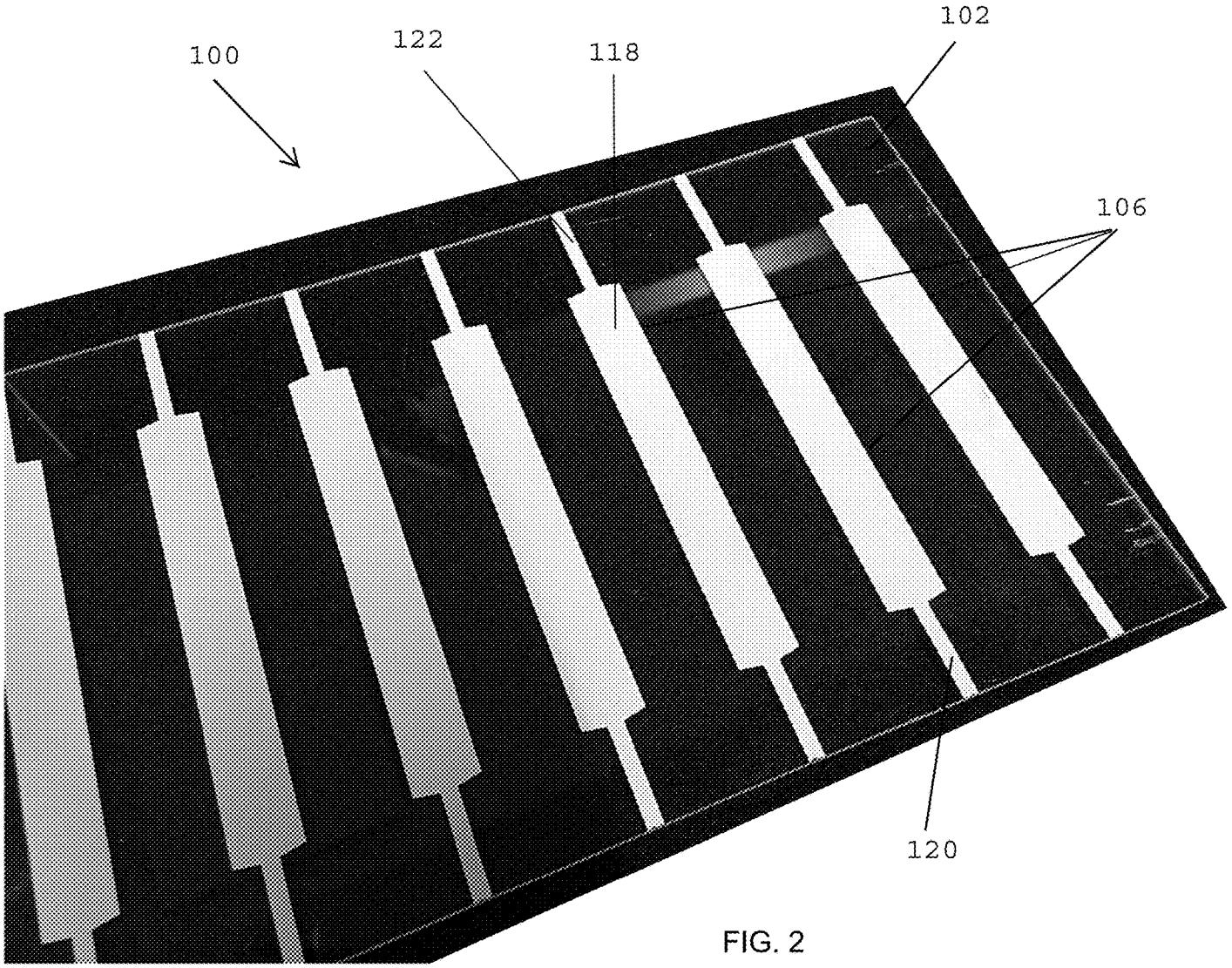
FIG. 2 illustrates a close-up view of the screen printed shield of FIG. 1 according to an example embodiment.

Turning now to the drawings, FIG. 1 illustrates an isometric view of a screen printed shield 100 according to an example embodiment. FIG. 2 illustrates a close-up view of the screen printed shield 100 of FIG. 1 according to an example embodiment. The screen printed shield 100 includes a panel 102 and a screen 104. In some example embodiments, the panel 102 may be an acrylic panel. Alternatively, the panel 102 may be a glass panel or another type of panel that is optically transparent. In some example embodiments, the degree of optical transparency of the panel 102 may be selected based on a particular application. For example, the panel 102 may have a relatively low degree of transparency (i.e., closer to opaque on a transparency scale) in some applications while the panel 102 may have relatively high transparency in other applications.

In some example embodiments, the panel 102 may have a rectangular shape as shown in FIGS. 1 and 2. For example, the panel 102 has a first longitudinal side 110 and a second longitudinal side 112. The panel 102 also has a first end side 114 and a second end side 116.

In some example embodiments, the screen 104 may be formed on the panel 102 covering sections of the panel 102 between the first end side 114 and the second end side 116 and between the first longitudinal side 110 and the second longitudinal side 112. For example, the screen 104 may cover sections of the panel 102 proximal to the first end side 114, proximal to the second end side 116 and sections therebetween. The screen 104 may cover sections of the panel 102 proximal to the first longitudinal side 110, proximal to the second longitudinal side 112 and sections therebetween.

To illustrate, the screen 104 may include optically opaque segments 106 that are spaced from each other. The gaps between the opaque segments 106 may allow light to pass between the opaque segments 106 from one broad side of the panel 106 to the other broad side of the panel 102 while the opaque segments 106 themselves at least partially block light from passing through. The distribution and amount of light that passes through the panel 102 may be changed by changing the locations of the segments 106 on the panel 102, the overall area of the panel 102 that is covered by the screen 104, and/or the pattern of the opaque segments 106.

In some example embodiments, the screen 106 may include the individual opaque segments 106 that are repeated across the length of the panel 102 between the first end side 114 and the second end side 116. For example, each opaque segment 106 may have a wide section 118 and narrow sections 120, 122. As shown in FIGS. 1 and 2, the wide section 118 may be more generally centrally located between the longitudinal side 110 and the longitudinal side 112 of the panel 102. The narrow section 120 may extend between an end of the wide section 118 and the longitudinal side 112, and the narrow section 122 may extend between another end of the wide section 118 and the longitudinal side 110. Because the narrow sections 120, 122 individually cover a smaller area of the panel 102 than the wide section 118, more light may pass through the broad sides of the panel 102 near the longitudinal sides 110, 112 than near the center of the panel 102 between the longitudinal sides 110, 112.

In some example embodiments, the opaque segments 106 may be optically reflective. For example, the opaque segments 106 may be white or may have a generally reflective color such as silver. To illustrate, by reflecting back a portion of the light in a general direction away from the panel 102 and by preventing a portion of the light from passing through the panel 102, the screen printed shield 100 may result in a desired or preferable light distribution.

In some example embodiments, the screen printed shield 100 may be formed using screen printing methods. For example, a mask having a pattern of open spaces in the shape of the opaque segments 106 may be placed on the panel 102 and a screen printing liquid may be pored over the mask such that the liquid covers the panel 102 through the pattern of open spaces. The mask may then be removed leaving the desired pattern of the screen 104 on the panel 102. Alternatively, the screen 106 may be formed from a vinyl material that may be attached to the panel 102 using an adhesive (e.g., heat resistant adhesive). A desired pattern of the opaque segments 106 may be formed by carving out desired shapes out of the vinyl material before or after attaching the vinyl material to the panel 102.

In some example embodiments, the screen 104 may be formed on a single broad side of the panel 102. Alternatively, the screen 104 may be formed on both broad sides of the panel 102. For example, some of the opaque segments 106 may be formed on the panel 102 on the top broad side in the orientation shown in FIGS. 1 and 2 while other opaque segments 106 are formed on the bottom broad side of the panel 102.

Although the opaque segments 106 are shown in FIGS. 1 and 2 as fully separated from each other, in alternative embodiments, the opaque segments 106 may be connected, for example, by segments of an opaque material that extend between, for example, adjacent opaque segments 106. Although the opaque segments 106 are shown in FIGS. 1 and 2 as being regularly spaced, in alternative embodiments, the opaque segments 106 may be spaced irregularly such that the gap between some adjacent opaque segments is smaller than the gap between other adjacent opaque segments. In some example embodiments, the opaque segments 106 may not be fully optically opaque. For example, the opaque segments 106 may be less transparent than the panel 102 without being fully opaque. Although the screen 104 is shown in FIGS. 1 and 2 as having a particular pattern of the opaque segments 106, in alternative embodiments, the screen 104 may have a different pattern of the opaque segments 106.

Figure 3:
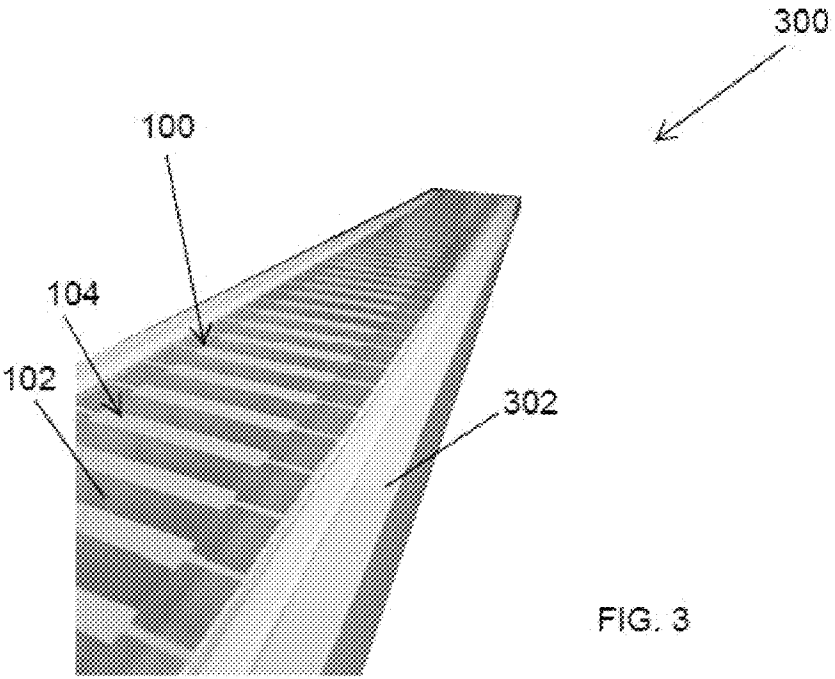
FIG. 3 illustrates a lighting fixture with the screen printed shield of FIG. 1 according to an example embodiment.

FIG. 3 is a lighting fixture 300 with the screen printed shield 100 of FIG. 1 according to an example embodiment. As shown in FIG. 3, the lighting fixture 300 may have a housing 302. For example, the lighting fixture 300 may be a suspended lighting fixture that emits light through a top side and a bottom side of the lighting fixture 300.

As shown in FIG. 3, the screen printed shield 100 is positioned on the upper side of the lighting fixture 300. For example, the lighting fixture 300 may include a light source (e.g., fluorescent bulb, a light emitting panel (LEP), etc.) within the housing 302 below the screen printed shield 100.

As described with respect to FIGS. 1 and 2, the screen printed shield 100 may allow a desired light distribution of the light emitted by the lighting fixture 300. For example, the screen printed shield 100 may reflect back some of the light emitted by the light source of the lighting fixture 300 such that the amount of uplight produced by the lighting fixture 300 is less as compared to the amount of uplight produced by a similar lighting fixture without the screen printed shield 100. Further, the screen printed shield 100 may reflect some of the light downward increasing the amount of downlight produced by the lighting fixture 300 while reducing the amount of uplight as compared to another similar lighting fixture without the screen printed shield 100.

In some example embodiments, the lighting fixture 300 may be a wall-mounted or another type of lighting fixture instead of a suspended lighting fixture. For example, the screen printed shield 100 may be used with a lighting fixture that produces uplight or downlight instead of both. To illustrate, the screen printed shield 100 may be used to produce a desired distribution of uplight, downlight, or both.

Figure 4:
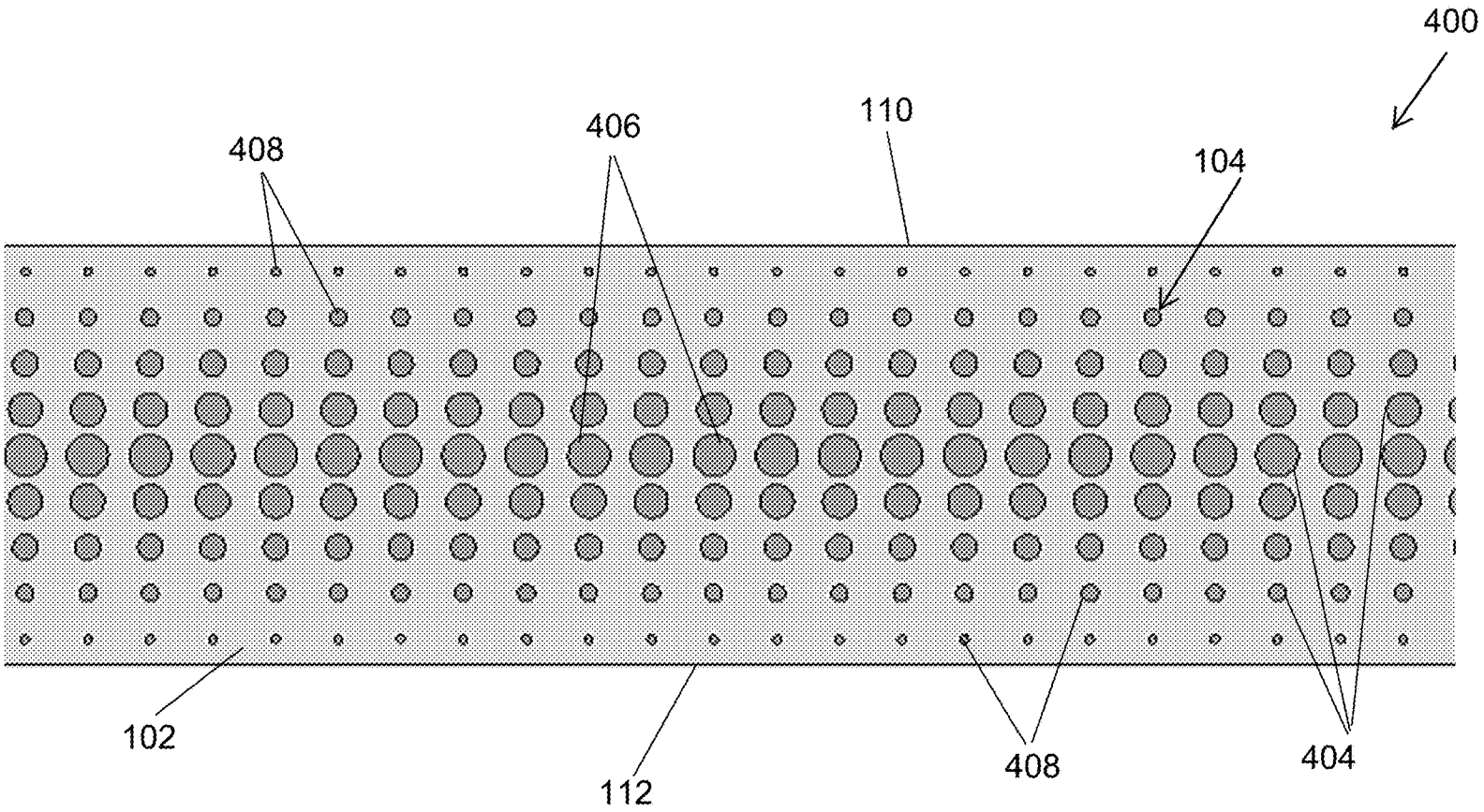
FIG. 4 illustrates a screen printed shield according to another example embodiment.

FIG. 4 illustrates a screen printed shield 400 according to another example embodiment. As illustrated in FIG. 4, the screen printed shield 400 may include the panel 102 and the screen 104. The screen 104 may include opaque segments 404. In some example embodiments, some opaque segments 408 may be relatively smaller than the other opaque segments 406.

In some example embodiments, the smaller opaque segments 408 may be positioned on the panel 102 closer to the longitudinal sides 110, 112 to allow more light to pass through the panel 102 closer to the longitudinal sides 110, 112 than near the center of the panel 102. To illustrate, the opaque segments 406 that are positioned near the center of the panel 102 are larger than the opaque segments 408 positioned closer to the longitudinal sides 110, 112. In some example embodiments, some of the opaque segments 404 of the screen 104 may be progressively larger in the directions from the longitudinal sides 110, 112 toward the center of the panel 102. To illustrate, the distribution of light produced by a lighting fixture that has the screen printed shield 100 may be different from the light distribution resulting from the use of the screen printed shield 400.

The screen printed shield 400 may be made in the same manner as described with respect to the screen printed shield 100 shown in FIGS. 1 and 2.

Although the opaque segments 404 are shown as generally circular, in some alternative embodiments, the opaque segments 404 may have other shapes without departing from the scope of this disclosure. Further, some of the opaque segments 404 may be omitted without departing from the scope of this disclosure. In some alternative embodiments, the opaque segments 404 may be spaced from each other differently than shown in FIG. 4 without departing from the scope of this disclosure.

Figure 5:
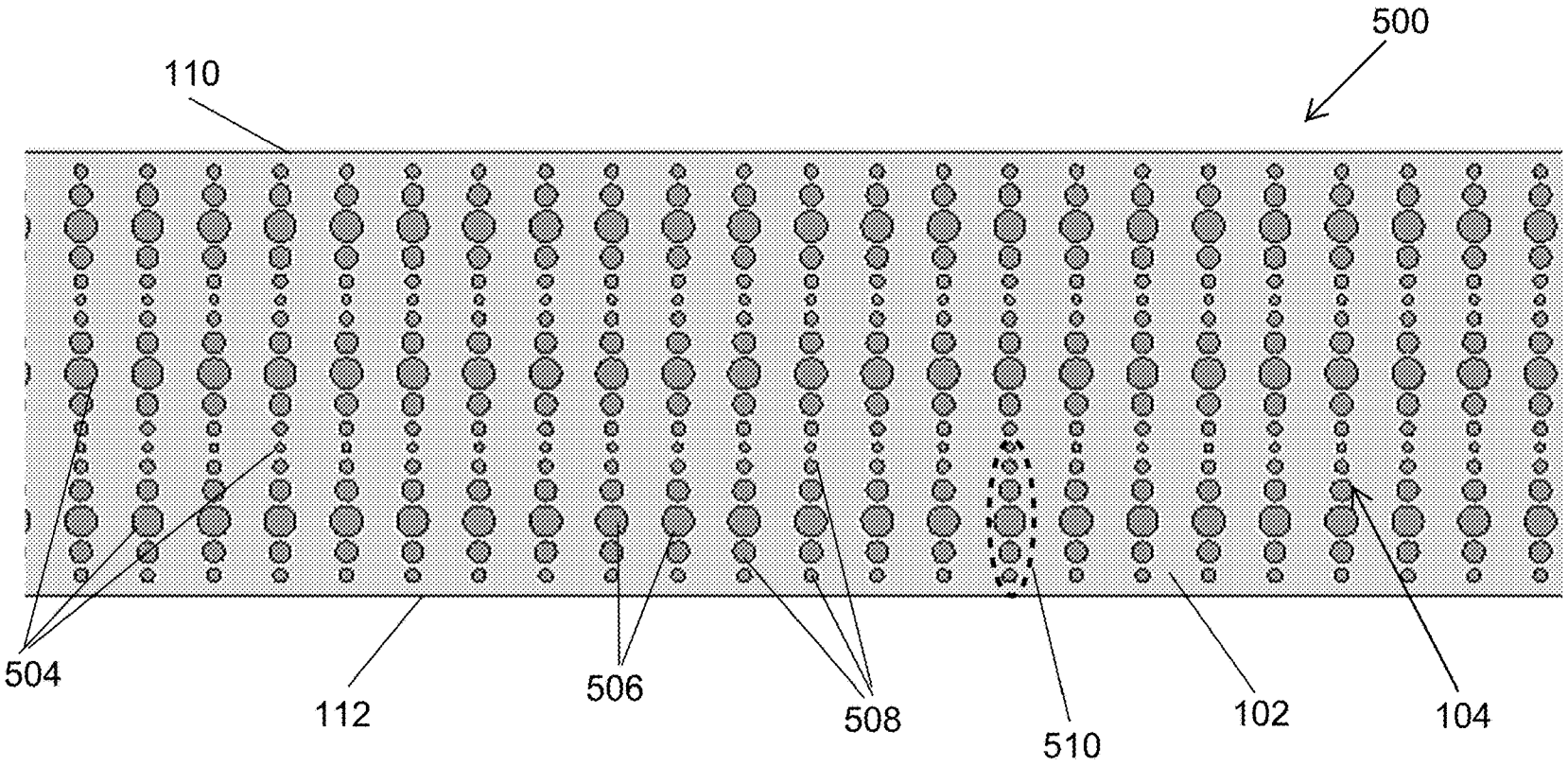
FIG. 5 illustrates a screen printed shield according to another example embodiment.

FIG. 5 illustrates a screen printed shield according to another example embodiment. As illustrated in FIG. 5, the screen printed shield 500 may include the panel 102 and the screen 104. The screen 104 may include opaque segments 504. In some example embodiments, some opaque segments 508 may be relatively smaller than the other opaque segments 406.

In some example embodiments, a particular pattern 510 of the opaque segments 504 may be repeated on the panel 102 between the longitudinal sides 110, 112. For example, the pattern 510 may include smaller opaque segments followed by larger opaque segments that are followed by smaller opaque segments. The areas of the panel 102 that are covered by relatively smaller opaque segments 504 are interspersed with areas of the panel 102 that are covered by relatively larger opaque segments 504. To illustrate, the distribution of light produced by a lighting fixture that has the screen printed shield 100 may be different from the light distribution resulting from the use of the screen printed shield 500.

The screen printed shield 400 may be made in the same manner as described with respect to the screen printed shield 100 shown in FIGS. 1 and 2.

Although the opaque segments 504 are shown as generally circular, in some alternative embodiments, the opaque segments 504 may have other shapes without departing from the scope of this disclosure. Further, some of the opaque segments 504 may be omitted without departing from the scope of this disclosure. In some alternative embodiments, the opaque segments 504 may be spaced from each other differently than shown in FIG. 5 without departing from the scope of this disclosure.

Figure 6:
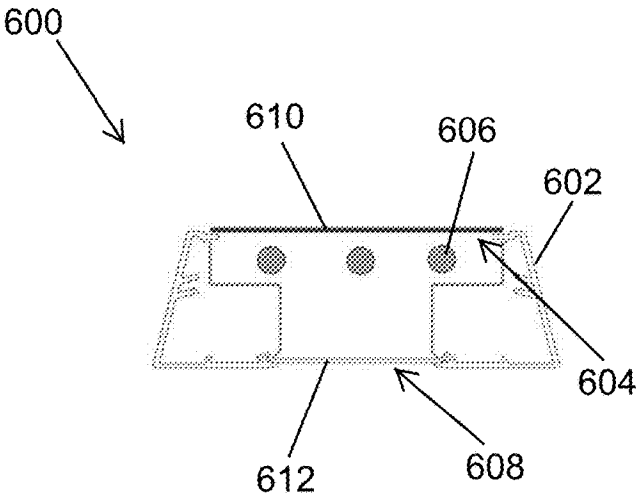
FIG. 6 illustrates an end side view of a lighting fixture with a screen printed shield according to an example embodiment.

FIG. 6 illustrates an end side view of a lighting fixture 600 with a screen printed shield 610 according to an example embodiment. The lighting fixture 600 includes a housing 602 having an upper opening 604 and a lower opening 608. For example, the lighting fixture 600 may produce uplight through the upper opening 604 and downlight through the lower opening 608.

In some example embodiments, the lighting fixture 600 includes one or more light sources 606. For example, each light source 606 may extend along a length the lighting fixture 600 (i.e., into the page). To illustrate, the light sources 606 may be fluorescent light sources.

As illustrated in FIG. 6, the lighting fixture 600 may include a lens 612 attached to the housing 602 at the lower opening 608 of the housing 602. For example, the downlight produced by the lighting fixture 600 exits the housing 602 through the lens 608.

In some example embodiments, the lighting fixture 600 includes a screen printed shield 610 disposed at the upper opening 604 of the housing 602. For example, the screen printed shield 610 may rest on the housing 602 covering the opening 604 of the housing 602. In some example embodiments, the screen printed shield 610 may be secured to the housing 604 with one or more fasteners such as screws and/or clips.

In some example embodiments, the screen printed shield 610 may fully cover the opening 604 of the housing 602. To illustrate, the uplight produced by the lighting fixture 600 exits the housing 602 through the screen printed shield 610. For example, the screen printed shield 610 may be the same or substantially the same as the screen printed shield 100 of FIG. 1, the screen printed shield 400 of FIG. 4, or the screen printed shield 500 of FIG. 5. Alternatively, the screen printed shield 610 may be different from the screen printed shields 100, 400, 500.

In some example embodiments, the amount and distribution of uplight and downlight produced by the lighting fixture 600 depends on the pattern of the screen of the screen printed shield 610. To illustrate, the screen printed shield 610 may result in an amount of uplight from the lighting fixture 600 that is less than the amount of uplight from another similar lighting fixture that does not have the screen printed shield 610. To illustrate, the screen printed shield 610 may block some of the light emitted upward by the light sources 606 from exiting the housing 602 through the opening 604. The screen printed shield 610 may also change the distribution of light emitted upward by the lighting sources 606 because of the pattern of the screen of the screen printed shield 610, such as the screen 104 shown in FIGS. 1-5.

In some example embodiments, the screen printed shield 610 may result in an amount of downlight from the lighting fixture 600 that is more than the amount of downlight from another similar lighting fixture that does not have the screen printed shield 610. To illustrate, the screen printed shield 610 may reflect downward some of the light emitted upward by the light sources 606 toward the lower opening 608 of the housing 602 such that the reflected light exits the housing 602 through the lower opening 608. The screen printed shield 610 may also change the distribution of downward light from the lighting fixture 600 because of the pattern of the screen of the screen printed shield 610.

To illustrate, the screen of the screen printed shield 610, similar to the screen 104 of the screen printed shield 100, 400, 500, may include opaque segments that are made from a reflective material. The screen of the screen printed shield 610 may reflect some of the light emitted by the light sources 606 down toward the lower opening 608, increasing the amount of downlight exiting through the lower opening 608. The amount and distribution of light reflected by the opaque segments of the screen of the screen printed shield 610 may depend on the pattern of the opaque segments of the screen.

In some example embodiments, the screen printed shield 610 may include multiple screen printed shields such as the screen printed shields 100, 400, and/or 500. To illustrate with respect to screen printed shield 100 of FIG. 1, the screen printed shield 610 may include multiple (e.g., two) screen printed shields 100 that are positioned adjacent to each other over the opening 604 of the housing 602. Alternatively, one screen printed shield 100 may be positioned or slid over another screen printed shield 100. For example, the opaque segments 106 of one screen printed shield 100 of FIG. 1 may be longitudinally offset from the opaque segments 106 of another screen printed shield 100 such that the combined pattern of the opaque segments 106 of the screen printed shields 100 may be changed by changing the relative positions of the screen printed shields 100.

In some example embodiments, the screen printed shield 610 may include two or more screen printed shields that have screens (e.g., screens 104 shown in FIGS. 1-5) with different patterns. By using screen printed shields having different screens (e.g., screens 104 shown in FIGS. 1-5) and changing the positions of the screen printed shields, such as the screen printed shields 100, 400, 500, relative to each other, the light distribution produced by the lighting fixture 600 may be changed.

Although a particular shape housing 602 is shown in FIG. 6, in some alternative embodiments, the housing 602 may have other shapes. Further, in some alternative embodiments, the housing 602 may not have the lower opening 608. In some alternative embodiments, the screen printed shield 610 may cover the opening 604 partially instead of the entire opening without departing from the scope of this disclosure.

Figure 7:
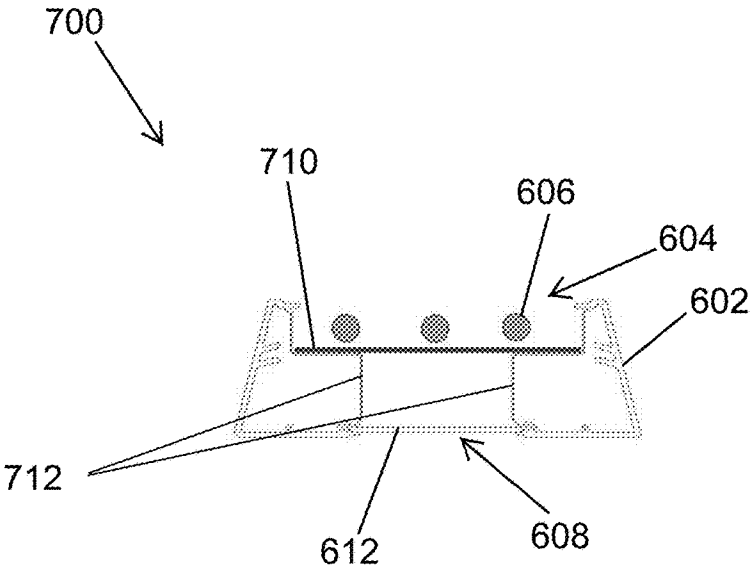
FIG. 7 illustrates an end side view of a lighting fixture with a screen printed shield according to another example embodiment.

FIG. 7 illustrates an end side view of a lighting fixture 700 with a screen printed shield 810 according to another example embodiment. The lighting fixture 700 includes a housing 602 having an upper opening 604 and a lower opening 608. For example, the lighting fixture 700 may produce uplight through the upper opening 604 and downlight through the lower opening 608.

In some example embodiments, the lighting fixture 700 includes one or more light sources 606. For example, each light source 606 may extend along a length the lighting fixture 700 (i.e., into the page). To illustrate, the light sources 606 may be fluorescent light sources.

As illustrated in FIG. 7, the lighting fixture 700 may include a lens 612 attached to the housing 602 at the lower opening 608 of the housing 602. For example, the downlight produced by the lighting fixture 700 exits the housing 602 through the lens 608.

In some example embodiments, the lighting fixture 700 includes a screen printed shield 710 disposed inside the housing 602. For example, the screen printed shield 710 may be positioned on a pair of frames 712 of the housing 610 below the light sources 606. The screen printed shield 710 is positioned such that downlight that exits the housing 602 through the lower opening 608 passes through the screen printed shield 710. In some example embodiments, the screen printed shield 710 may be secured to the housing 604 with one or more fasteners such as screws and/or clips.

In some example embodiments, the screen printed shield 710 may be positioned such that all downlight from the lighting fixture 700 emitted through the opening 608 of the housing 602 passes through the screen printed shield 710. Alternatively, the screen printed shield 710 may be positioned such that less than all the downlight from the lighting fixture 700 passes through the screen printed shield 710.

In some example embodiment, the screen printed shield 710 may be the same or substantially the same as the screen printed shield 100 of FIG. 1, the screen printed shield 400 of FIG. 4, or the screen printed shield 500 of FIG. 5. Alternatively, the screen printed shield 710 may be different from the screen printed shields 100, 400, 500.

In some example embodiments, the amount and distribution of uplight and downlight produced by the lighting fixture 700 depends on the pattern of the screen of the screen printed shield 710. To illustrate, the screen printed shield 710 may result in an amount of downlight from the lighting fixture 700 that is less than the amount of downlight from another similar lighting fixture that does not have the screen printed shield 710. To illustrate, the screen printed shield 710 may block some of the light emitted downward by the light sources 606 from exiting the housing 602 through the opening 608. The screen printed shield 710 may also change the distribution of light emitted downward by the lighting sources 606 because of the pattern of the screen of the screen printed shield 710, such as the screen 104 shown in FIGS. 1-5.

In some example embodiments, the screen printed shield 710 may result in an amount of uplight from the lighting fixture 700 that is more than the amount of uplight from another similar lighting fixture that does not have the screen printed shield 710. To illustrate, the screen printed shield 710 may reflect upward some of the light emitted downward by the light sources 606 toward the upper opening 604 of the housing 602 such that the reflected light exits the housing 602 through the upper opening 604. The screen printed shield 710 may also change the distribution of downward light from the lighting fixture 700 because of the pattern of the screen of the screen printed shield 710.

To illustrate, the screen of the screen printed shield 710, similar to the screen 104 of the screen printed shield 100, 400, 500, may include opaque segments that are made from a reflective material. The screen of the screen printed shield 710 may reflect some of the light emitted by the light sources 606 down toward the lower opening 608, increasing the amount of downlight exiting through the lower opening 608. The amount and distribution of light reflected by the opaque segments of the screen of the screen printed shield 710 may depend on the pattern of the opaque segments of the screen.

In some example embodiments, the screen printed shield 710 may include multiple screen printed shields such as the screen printed shields 100, 400, and/or 500. To illustrate with respect to screen printed shield 100 of FIG. 1, the screen printed shield 710 may include multiple (e.g., two) screen printed shields 100 that are positioned adjacent to each other inside the housing 602. Alternatively, one screen printed shield 100 may be positioned or slid over another screen printed shield 100. For example, the opaque segments 106 (shown in FIG. 1) of one screen printed shield 100 of FIG. 1 may be longitudinally offset from the opaque segments 106 of another screen printed shield 100 such that the combined pattern of the opaque segments 106 of the screen printed shields 100 may be changed by changing the relative positions of the screen printed shields 100.

In some example embodiments, the screen printed shield 710 may include two or more screen printed shields that have screens (e.g., screens 104 shown in FIGS. 1-5) with different patterns. By using screen printed shields having different screens (e.g., screens 104 shown in FIGS. 1-5) and changing the positions of the screen printed shields, such as the screen printed shields 100, 400, 500, relative to each other, the light distribution produced by the lighting fixture 700 may be changed.

In some alternative embodiments, the housing 602 may not have the upper opening 604 without departing from the scope of this disclosure.

Figure 8:
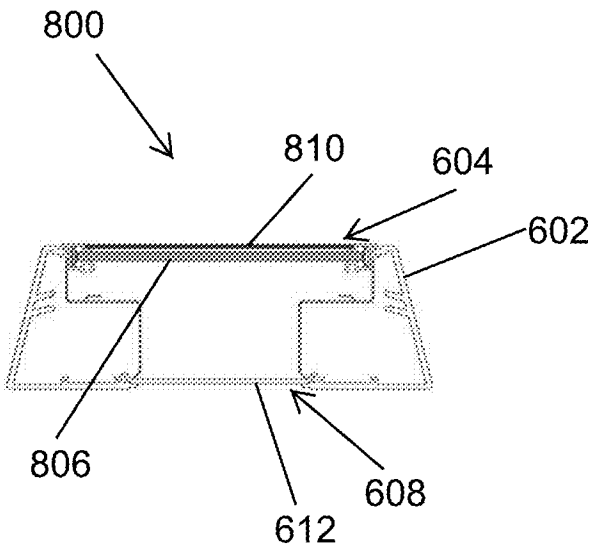
FIG. 8 illustrates an end side view of a lighting fixture with a screen printed shield according to another example embodiment.

FIG. 8 illustrates an end side view of a lighting fixture 800 with a screen printed shield 810 according to another example embodiment. The lighting fixture 800 is substantially the same as the lighting fixture 600 and the description of some features of the lighting fixture are omitted here for the sake of brevity.

As illustrated in FIG. 8, the lighting fixture 800 includes a light emitting panel (LEP) 806 that is the light source of the lighting fixture 800. For example, the LEP 806 may be positioned proximal to the upper opening 604 and may substantially cover the upper opening 604. The LEP may be designed to emit a light such that a portion of the light is emitted upward toward the upper opening 604 and a portion of the light is emitted downward toward the lower opening 608.

In some example embodiments, the screen printed shield 810 may be positioned at the upper opening 604, above the LEP 806. As described with respect to the screen printed shield 610 of FIG. 6, the screen printed shield 810 may block some of the light from the LEP 806 that is emitted upward. The screen printed shield 810 may also reflect some of the light from the LEP 806 that is emitted upward back toward the LEP 806, which may increase the amount of downlight that exits the housing 603 through the lower opening 608. The distribution of the uplight and downlight produced by the lighting fixture 800 may also be dependent on the particular pattern of the screen (e.g., the screen 104 of the screen printed shield 100, 400, 500) of the screen printed shield 806 as described above.

Similar to the screen printed shield 610, the screen printed shield 810 may include multiple screen printed shields such as the screen printed shields 100, 400, and/or 500.

Figure 9:
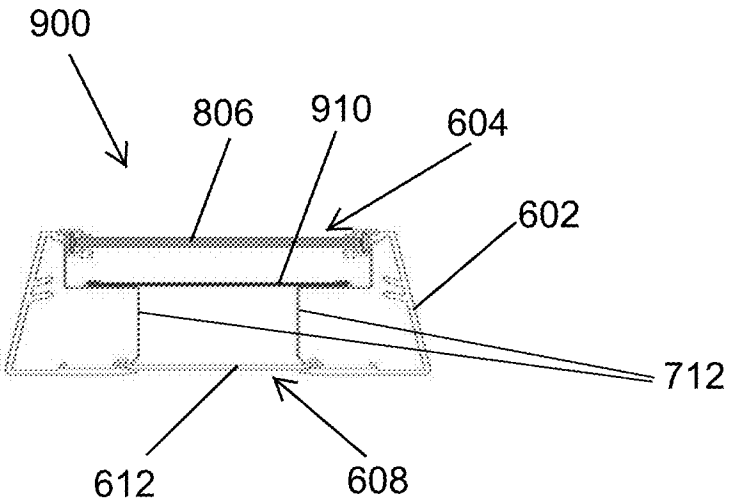
FIG. 9 illustrates an end side view of a lighting fixture with a screen printed shield according to another example embodiment.

FIG. 9 illustrates an end side view of a lighting fixture 900 with a screen printed shield 910 according to another example embodiment. In some example embodiments, the lighting fixture 900 includes the screen printed shield 710 disposed inside the housing 602. For example, the screen printed shield 810 may be positioned on a pair of frames 712 of the housing 610 below LEP 806. The screen printed shield 810 may be positioned such that downlight that exits the housing 602 through the lower opening 608 passes through the screen printed shield 810. In some example embodiments, the screen printed shield 810 may be secured to the housing 604 with one or more fasteners such as screws and/or clips.

As described with respect to the screen printed shield 710 of FIG. 7, the screen printed shield 910 may block some of the light from the LEP 806 that is emitted downward. The screen printed shield 910 may also reflect some of the light from the LEP 806 that is emitted downward back toward the LEP 806, which may increase the amount of uplight that exits the housing 602 through the upper opening 604. The distribution of the uplight and downlight produced by the lighting fixture 900 may also be dependent on the particular pattern of the screen (e.g., the screen 104 of the screen printed shield 100, 400, 500) of the screen printed shield 806 as described above.

Similar to the screen printed shield 610, the screen printed shield 910 may include multiple screen printed shields such as the screen printed shields 100, 400, and/or 500.

Figure 10:
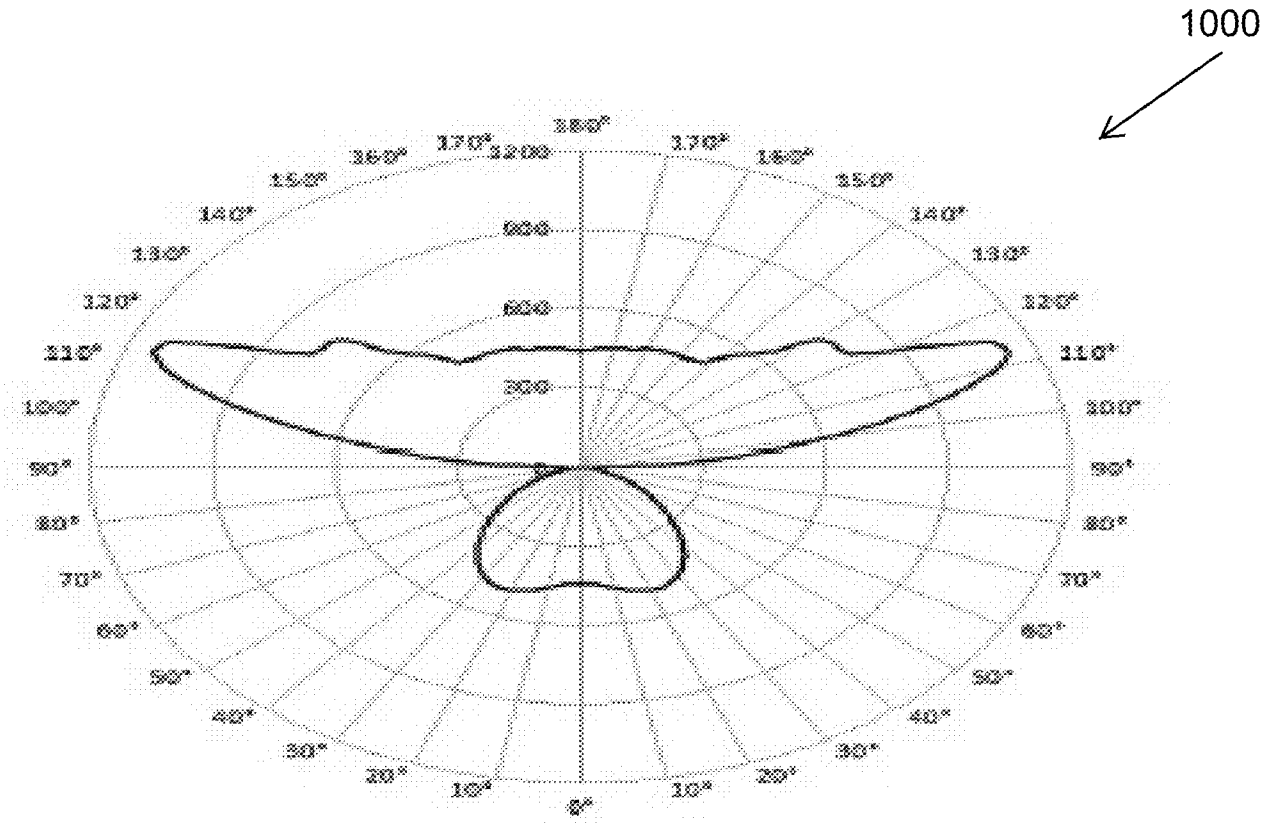
FIG. 10 illustrates a polar plot of light emitted by a lighting fixture without a screen printed shield according to an example embodiment.
Figure 11:
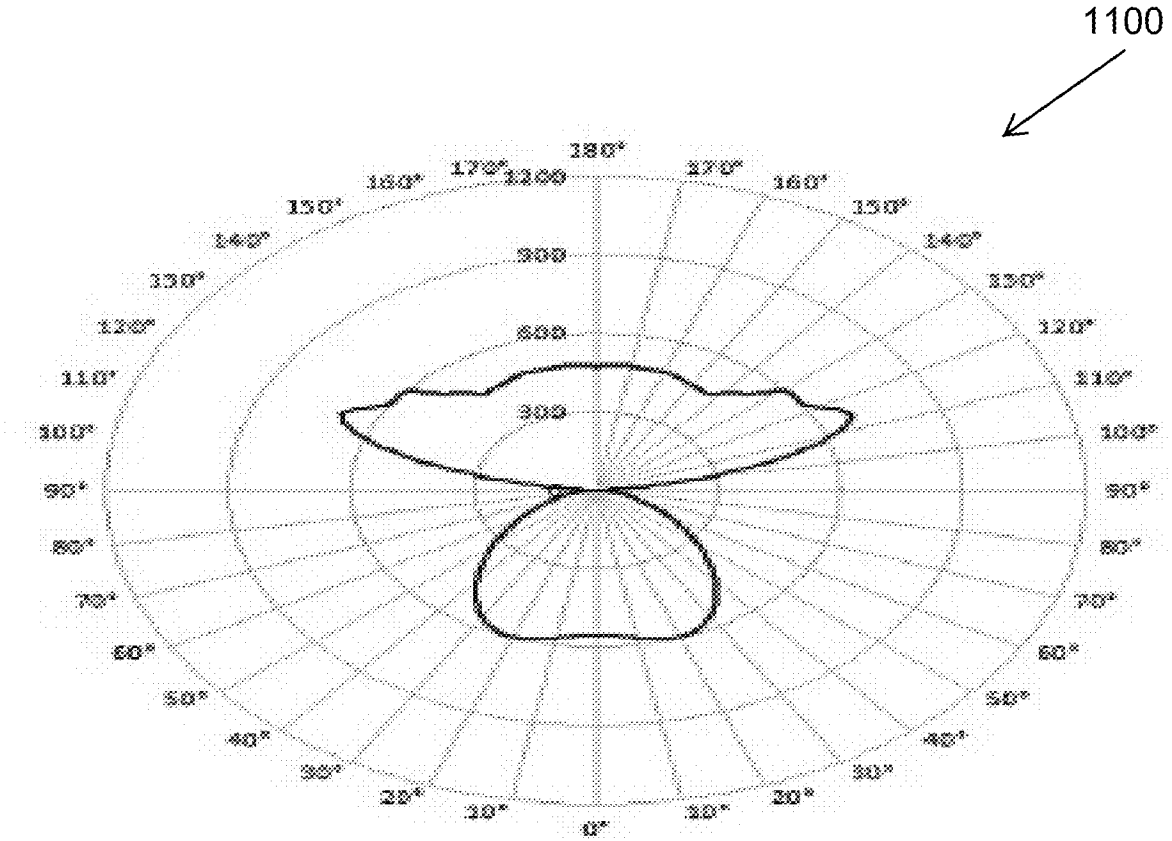
FIG. 11 illustrates a polar plot of light emitted by a lighting fixture with a screen printed shield positioned above the light source of the lighting fixture according to an example embodiment.
Figure 12:
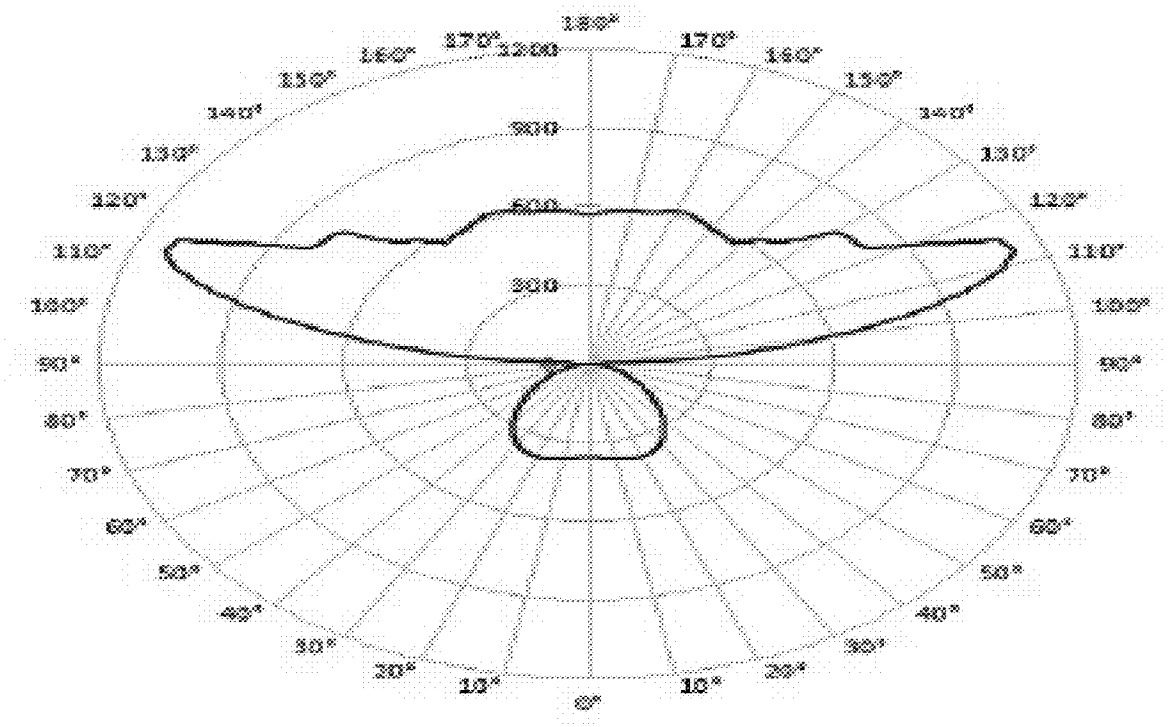
FIG. 12 illustrates a polar plot of light emitted by a lighting fixture with a screen printed shield positioned below the light source of the lighting fixture according to an example embodiment.

FIG. 10 illustrates a polar plot 1000 of light emitted by a lighting fixture without a screen printed shield according to an example embodiment. FIG. 11 illustrates a polar plot 1100 of light emitted by a lighting fixture with a screen printed shield positioned above the light source of the lighting fixture according to an example embodiment. FIG. 12 illustrates a polar plot 1200 of light emitted by a lighting fixture with a screen printed shield positioned below the light source of the lighting fixture according to an example embodiment. To illustrate, the polar plot 1000 may represent 66% uplight and 34% downlight produced by the light fixture such as the light fixture 600, 800 without the screen printed shield 610.

In some example embodiments, polar plot 1100 may represent 56% uplight and 44% downlight produced by the light fixture such as the light fixture 600 with the screen printed shield 610 or the lighting fixture 800 with the screen printed shield 810. In some example embodiments, polar plot 1200 may represent 74% uplight and 26% downlight produced by the light fixture such as the light fixture 700 with the screen printed shield 710 or the lighting fixture 900 with the screen printed shield 910. As can be seen from the polar plots 1000, 1100, 1200, the amount and distribution of uplight and downlight produced by a light fixture such may be changed by using the screen printed shield 100, 400, 500, or another similar screen printed shield.

Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A light fixture, comprising:

a housing;

a light source disposed within the housing;

a shield attached to the housing, wherein the shield is disposed below the light source, the shield comprising:

a panel that is optically transparent; and a screen attached to the panel, the screen having opaque segments, wherein the opaque segments have gaps therebetween, wherein the screen is screen printed onto the panel, and wherein the opaque segments are distributed on the panel in a pattern; and a lens positioned below the light source, wherein the shield is positioned inside the housing below the light source and above the lens.

2. The light fixture of claim 1, wherein the panel is made from acrylic.

3. The light fixture of claim 1, wherein the panel is made from glass.

4. The light fixture of claim 1, wherein the screen is made from a reflective material.

5. The light fixture of claim 1, wherein the pattern is designed to provide a desired light distribution above and below the housing.

6. The light fixture of claim 1, wherein the light source includes a light emitting panel.

7. The light fixture of claim 1, wherein the light source includes a fluorescent light source.

8. The light fixture of claim 1, wherein the screen allows light to pass through between the opaque segments.

9. The light fixture of claim 1, wherein the housing comprises a top opening and a bottom opening and wherein the light source is disposed within the housing and configured to emit a light that includes an uplight that exits the housing through the top opening and a downlight that exits the housing through the bottom opening.

* * * * *